United States Patent [19]

Cobb et al.

[11] 4,201,114

[45] May 6, 1980

[54] ELECTROHYDRAULIC SERVOVALVE HAVING REMOVABLY ATTACHED FEEDBACK ELEMENT

[75] Inventors: Clyde E. Cobb, Lakeview Terrace; Donald A. Muths, Lake Hughes, both of Calif.

[73] Assignee: Textron Inc., Providence, R.I.

[21] Appl. No.: 953,652

[22] Filed: Oct. 23, 1978

[51] Int. Cl.[2] ..... F15B 13/16

[52] U.S. Cl. ..... 91/3; 91/365; 91/386; 91/387; 137/625.61; 137/625.64; 403/4; 403/24

[58] Field of Search ..... 91/365, 386, 387, 3; 137/625.61, 625.64; 403/4, 24, 389

[56] References Cited

U.S. PATENT DOCUMENTS

| | | | |
|---|---|---|---|
| 2,461,851 | 2/1949 | Stoples | 403/4 |
| 3,218,936 | 11/1965 | Anderson et al. | 91/365 |
| 3,401,603 | 9/1968 | Coakley et al. | 91/3 |
| 3,584,649 | 6/1971 | Cobb | 137/625.61 |
| 3,750,532 | 8/1973 | Kubilos | 91/387 |
| 3,915,427 | 10/1975 | Swogger | 91/3 |

*Primary Examiner*—Paul E. Maslousky

*Attorney, Agent, or Firm*—Nilsson, Robbins, Dalgarn, Berliner, Carson & Wurst

[57] ABSTRACT

An electrohydraulic servovalve including a second stage piston slidably mounted within a housing and movable responsive to application of pressure signals thereacross to control the flow of fluid under pressure from a source to a load in response to electrical input signals applied to the servovalve. The electrical signals are applied to a torque motor which has a driven member affixed thereto which generates the pressure signals applied to the spool. A mechanical feedback member is connected between the driven member and the spool. The mechanical feedback member is part of an assembly which is removably attached to the driven member. The removable attachment includes a tang extending radially from the driven member which receives a holder to which the feedback member is permanently affixed. The holder includes opposed flanges one of which receives the tang through an indexing opening provided therein. The tang resides in a space defined between the flanges and further the holder includes means for clamping the holder to the tang to position the feedback member in its normal operational position.

12 Claims, 5 Drawing Figures

ELECTROHYDRAULIC SERVOVALVE HAVING REMOVABLY ATTACHED FEEDBACK ELEMENT

BACKGROUND OF THE INVENTION

In electrohydraulic servovalves having mechanical feedback elements included as a part thereof, it is not uncommon that the spring rate of the feedback member varies from one such valve to another. Such variation results from differences in manufacturing tolerances, materials and the like which are non-adjustable subsequent to the construction of the valve during production assembly.

If the particular spring rate of the feedback member is improper for the desired function of the particular valve, it is then necessary to replace the feedback element with one having a more appropriate spring rate. In the past, such replacement requires major disassembly of the entire servovalve and a consequent build up thereof after replacement of the feedback element with a different one having a proper spring rate. Such a necessity is time consuming, cumbersome and adds to the cost of the electrohydraulic servovalve.

The best prior art known to applicants are U.S. Pat. Nos.: 2,226,345; 2,704,997; 2,461,851; 3,554,084; 2,564,355.

SUMMARY OF THE INVENTION

An electrohydraulic servovalve including a body having a movable spool positioned therein with a torque motor having a driven member responsive to electrical signals applied thereto mounted thereon. A mechanical feedback member is connected between the spool and the driven member in such a manner as to be removable. The connection means includes a tang extending from the driven member which is received within a holder to which the feedback member is affixed. The holder defines opposed flanges one of which defines an indexing aperture positioned to receive the tang when the holder is rotated to a non-operational position and when the holder is returned to its normal operational position to have the tang positioned internally thereof. Means is provided to clamp the holder to the tang to position the feedback member is its normal operational position.

DETAILED DESCRIPTION OF THE INVENTION

Figure 1:
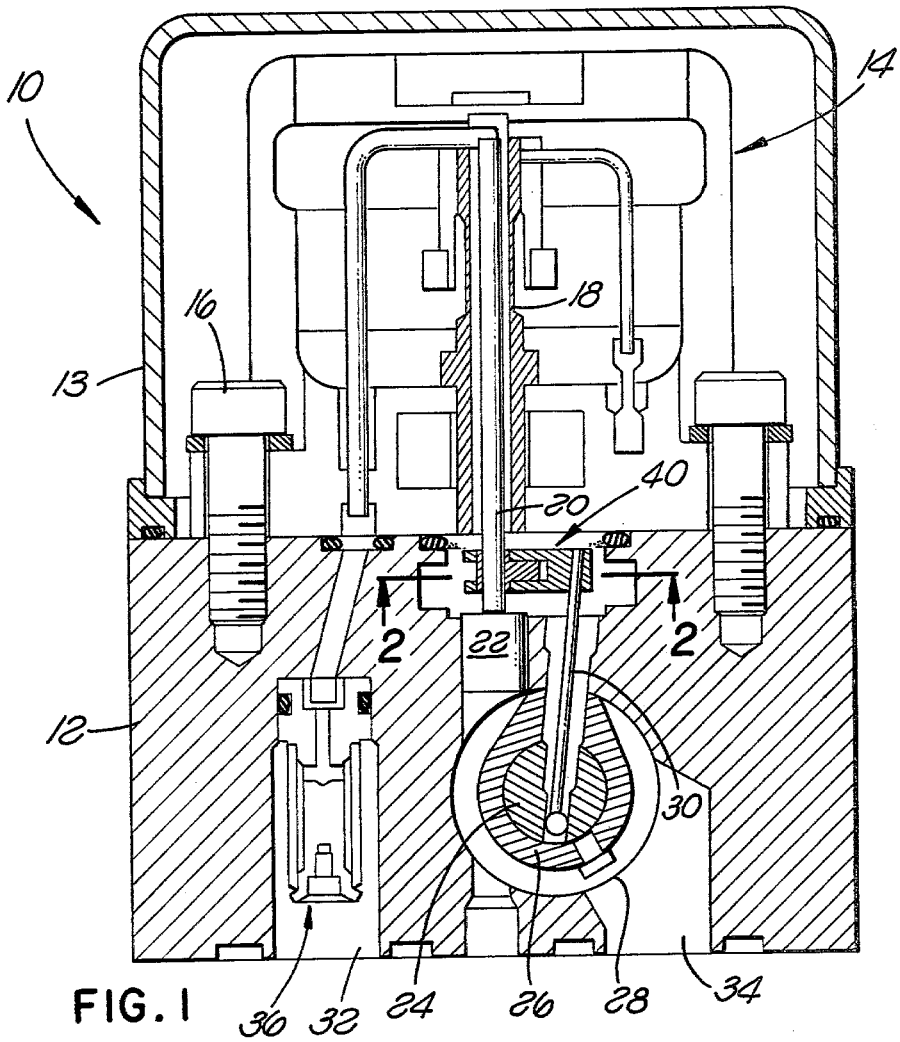
FIG. 1 is a schematic representation of an electrohydraulic servovalve, partly in cross section, illustrating the present invention.

In FIG. 1 there is illustrated in schematic diagram and partially in cross section an electrohydraulic servovalve constructed in accordance with the principles of the present invention. As is well known to those skilled in the art, an electrohydraulic servovalve receives electrical signals which are appled to a torque motor in accordance with given control information. The torque motor in response to the electrical signals causes movement of an armature therein to which is connected a driven member. The driven member may be a jet pipe or a flapper. In either event, movement of the driven member generates differential pressure signals which are in turn applied across a spool valve mounted in the body of the electrohydraulic servovalve. As the spool valve moves, hydraulic fluid from a source under pressure, is applied to a load member to cause movement thereof. Mechanical feedback is applied from the spool to the driven member to properly stabilize operation of the overall system.

The electrohydraulic servovalve as illustrated in FIG. 1 generally at 10 includes a body 12 having a cover 13 mounted thereon. Internally of the cover 13 is a torque motor assembly which is fastened to the body 12 by appropriate fastening means such as the bolts 16. A flexure tube 18 extends from the torque motor assembly 14 to the body 12 and seals the torque motor assembly 14 from the hydraulic fluid as is well known to those skilled in the art. A driven member such as a jet pipe 20 extends from the torque motor and is positioned adjacent receiver ports 22. As is well known the jet pipe 20 has hydraulic fluid under pressure eminating therefrom and its tip moves with respect to the receiver ports in response to signals applied to the torque motor 14. As the jet pipe 20 thus moves, differential pressure signals are set up in the receiver ports and are applied to opposite ends of a spool valve 24. The spool valve 24 is slidably positioned within a sleeve 26 which in turn is positioned within a bore 28 formed in the body 12.

A feedback spring 30 is positioned internally of the spool 24 and is attached to the driven member-jet pipe 20 by an appriopriate attaching assembly 40.

As will be recognized by those skilled in the art, appropriate ports such as a supply port 32 and a return port 34 are provided along with flow ports for the load and a supply port and filter assembly 36 for the jet pipe 20 to provide an operational electrohydraulic servovalve. Since the electrohydraulic servovalve is well known to those skilled in the art as is the operation thereof, no further detailed description of construction, assembly or operation is deemed necessary for those skilled in the art.

By reference to FIGS. 2 through 5, the attaching assembly 40 is illustrated in greater detail. As is therein shown there is provided a tang 42 extending radially from the driven member such as the jet pipe 20. The tang 42 is formed integrally with a collar 44 which surrounds the jet pipe 20 and is affixed thereto permanently as by welding or brazing. There is also provided a holder 46 for receiving the feedback spring 30. The holder 46 includes a body 48 and a pair of flanges 50 and 52 extending from the body 48 in opposed relationship. The flanges 50 and 52 define apertures 54 ad 56 therein. The apertures 54 and 56 have a diameter slightly larger than the outer diameter of the collar 44 so that the collar will fit snugly therewithin as will be more fully described hereinafter.

The body 48 also defines a feedback spring receiving aperture 58. The feedback spring 30 is received therein and is permanently affixed thereto as by electron beam welding or the like. As will be noted particularly with respect to FIG. 3, the aperture 58 is formed at a slight angle with respect to the jet pipe 20 to thereby provide appropriate alignment between the feedback spring and the spool valve 24 as more particularly shown in FIG. 1.

Figure 2:
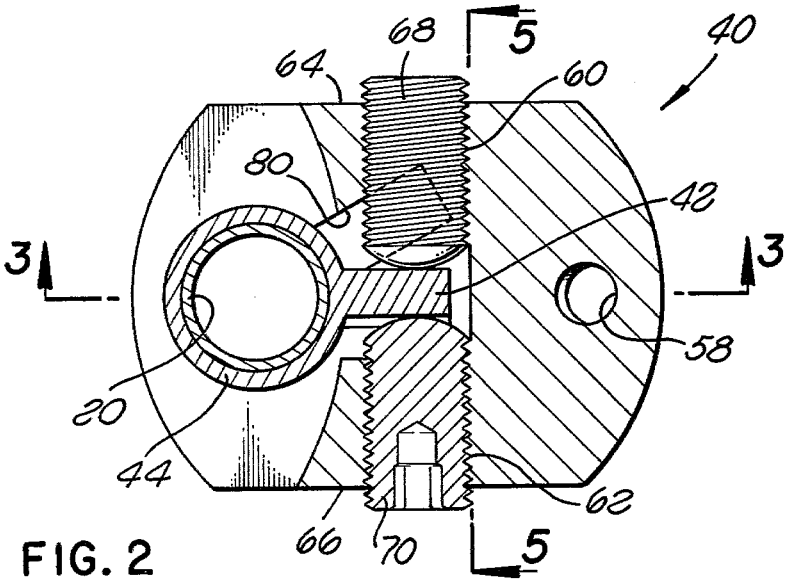
FIG. 2 is a cross sectional view taken about the lines 2—2 of FIG. 1 and illustrates the detachably securing means for attaching the feedback element to the driven member of the servovalve.
Figure 3:
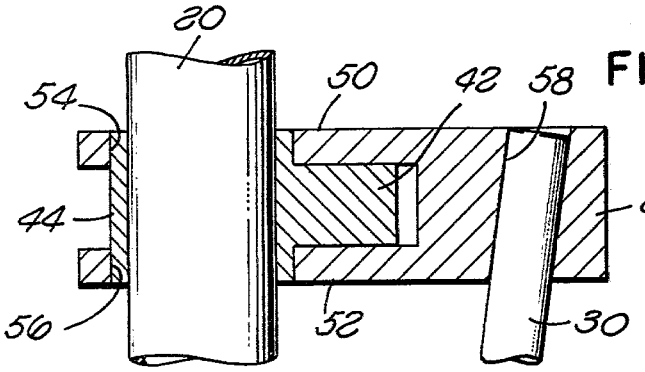
FIG. 3 is a view of the structure of FIG. 2 taken about the lines 3—13 of FIG. 2.
Figure 5:
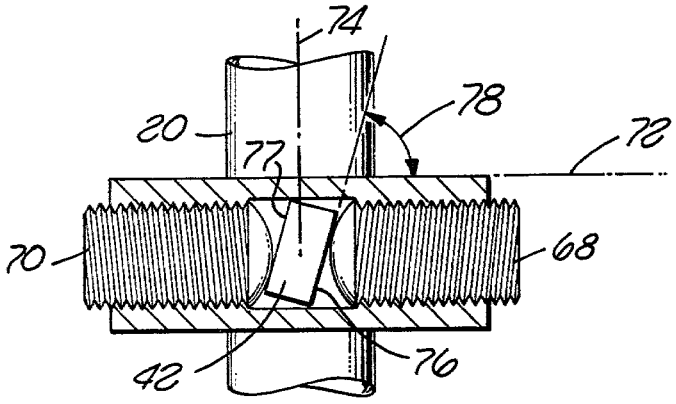
FIG. 5 is a cross sectional view taken about the lines 5—5 of FIG. 2 illustrating the clamping of the holder to the tang.

A pair of threaded bores 60 and 62 are provided in the opposite side edges 64 and 66, respectively of the body 48. The threaded bores 60 and 62 receive a pair of set screws 68 and 70, respectively. As is illustrated in FIG. 2, when the tang 42 is positioned internally of the holder 46, the set screws are used as a clamping means to hold the feedback spring 30 in its operational position with respect to the spool 24. As will be well understood by those skilled in the art, the set screws 68 and 70 may be manipulated to adjust the position of the feedback spring with respect to the spool valve 24 and the jet pipe 20 during construction and testing of the electrohydraulic servovalve.

To assure total elimination of any backlash between the jet pipe 20 and the feedback spring 30, the tang is formed so as to be angularly offset with respect to a plane positioned orthogonally to the longitudinal axis of the jet pipe 20. Such is more fully illustrated in FIG. 5. As is therein shown if any imaginary plane illustrated by the line 72 is disposed orthogonally to the longitudinal axis 74 of the jet pipe 20 then a line extended from the side edge 76 forms an acute angle 78 with respect to the plane 72. With the tang thus angularly offset the position of contact by the set screws 68 and 70 with the two side edges 76 and 77, respectively of the tang 42 will cause any clearance existing between the collar 44 and the openings 54 and 56 in the flanges 50 and 52 to be eliminated.

Figure 4:
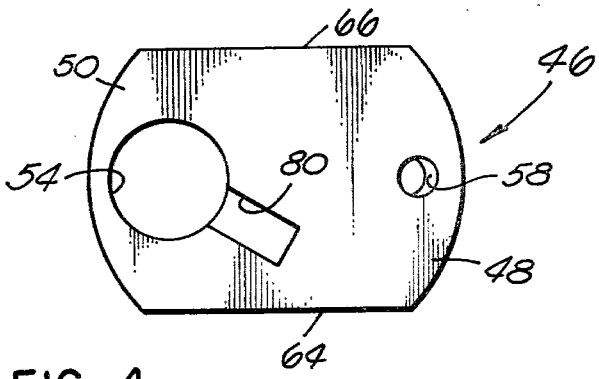
FIG. 4 is a top elevational view of the feedback member holder.

By specific reference to FIG. 4 it will be noted that the aperture 54 formed in the flange 50 also includes a keyway-like indexing aperture or slot 80. The slot 80 is formed to receive the tang 42 in assembly of the holder 46 to the driven member 20 (subsequent to assembly of the feedback spring 30 thereinto). The holder 46 is rotated so as to permit the tang 42 to pass through the slot 80 while the collar 44 passes through the aperture 54. When the tang 42 is positioned between the flanges 50 and 52 and the collar 42 is received within the apertures 54 and 56 the holder is then rotated to position the tang 42 as is illustrated in FIG. 2 which places the tang in a position so that the feedback spring is close to its normal operational position. Thereafter, the set screws 68 and 70 are appropriately adjusted to effect desired operation of the electrohydraulic servovalve 10 after which the set screw 68 and 70 are firmly seated to thus clamp the entire assembly in its normal operational position.

By reference to FIG. 2, the specific relationship between the slot 80, the aperture 54 and the tang 42 when in its operational position can be more clearly seen, the slot 80 being shown in phantom lines in FIG. 2.

As will now be recognized by those skilled in the art, after the assembly of an electrohydraulic servovalve as illustrated in FIG. 1 has been accomplished and during testing it is discovered that the spring rate of the feedback spring 30 is improper, the feedback spring may easily be replaced. Such is readily accomplished merely by removing the cover 13 and the torque motor assembly 14 through removal of the bolts 16. Thereupon the set screws 68 and 70 may be loosened, the holder rotated to the indexing aperture 80 thus permitting the holder 46 to be removed from the jet pipe 20. A new holder and feedback spring assembly having a different and desired spring rate can then be placed upon the jet pipe 20 as above described and then properly adjusted and clamped into position. Therefore it can be seen that easy and rapid exchange of feedback spring assemblies can be accomplished through utilization of the present invention.

What is claimed is:

1. Electrohydraulic servovalve comprising:

(A) a torque motor having a member driven responsive to electrical signals applied thereto to produce pressure signals;

(B) a spool movable responsive to application of said pressure signals thereto;

(C) a mechanical feedback member connected between said spool and said driven member for providing spool positional signals to said driven member during normal operation of said valve;

(D) a tang extending radially from said driven member;

(E) a holder for receiving said feedback member and having:

(1) a body, and (2) first and second opposed flanges extending from said body and defining aligned apertures therethrough for receiving said driven member, (3) one of said flanges defining an indexing aperture intersecting said opening therein for receiving said tang, said indexing aperture being displaced from the normal operational position of said feedback member; and (F) means for clamping said holder to said tang to position said feedback member in a normal operational position.

2. Apparatus as defined in claim 1 wherein said tang includes a collar surrounding said driven member and permanently affixed thereto, said tang being formed as an integral part of said collar.

3. Apparatus as defined in claim 2 wherein said apertures in said flanges are sufficiently large to receive said collar in a slip fit.

4. Apparatus as defined in claim 2 wherein said clamping means includes means for adjusting said holder relative to said driven member thereby to position said feedback member.

5. Apparatus as defined in claim 4 wherein said clamping means includes a pair of set screws threadably received in opposite sides of said body.

6. Apparatus as defined in claim 5 wherein said tang is acutely angularly offset with respect to a plane orthogonal to the longitudinal axis of said drive member.

7. Apparatus for removably attaching a mechanical feedback member to a torque motor driven member in an electrohydraulic servovalve comprising:

(A) a tang extending radially from said driven member;

(B) a holder for receiving said feedback member and having:

(1) a body, and (2) first and second opposed flanges extending from said body and defining aligned apertures therethrough for receiving said driven member, (3) one of said flanges defining an indexing aperture intersecting said opening therein for receiving said tang, said indexing aperture being displaced from the normal operational position of said feedback member; and (C) means for clamping said holder to said tang to position said feedback member in a normal operational position.

8. Apparatus as defined in claim 7 wherein said tang includes a collar surrounding said driven member and permanently affixed thereto, said tang being formed as an integral part of said collar.

9. Apparatus as defined in claim 8 wherein said apertures in said flanges are sufficiently large to receive said collar in a slip fit.

10. Apparatus as defined in claim 7 wherein said clamping means includes means for adjusting said holder relative to said driven member thereby to position said feedback member.

11. Apparatus as defined in claim 10 wherein said clamping means includes a pair of set screws threadably received in opposite sides of said body.

12. Apparatus as defined in claim 11 wherein said tang is acutely angularly offset with respect to a plane orthogonal to the longitudinal axis of said drive member.

* * * * *